United States Patent [19]

Knöchel et al.

[11] Patent Number: 4,806,941

[45] Date of Patent: Feb. 21, 1989

[54] MICROWAVE COMPONENT

[75] Inventors: Reinhard Knöchel, Elmshorn; Jürgen Köhler, Halstenbek, both of Fed. Rep. of Germany

[73] Assignee: U.S. Philips Corporation, New York, N.Y.

[21] Appl. No.: 48,192

[22] Filed: May 11, 1987

[30] Foreign Application Priority Data

May 17, 1986 [DE] Fed. Rep. of Germany ..... 3616723

[51] Int. Cl.[4] ..... H01Q 00/00

[52] U.S. Cl. ..... 343/700 MS

[58] Field of Search ..... 343/700 MS, 803, 846

[56] References Cited

U.S. PATENT DOCUMENTS 4,445,122 4/1984 Pues ..... 343/700 MS 4,623,893 11/1986 Sabban ..... 343/700 MS 4,700,194 10/1987 Ogawa et al. ..... 343/700 MS

*Primary Examiner*—John D. Lee

*Assistant Examiner*—Robert E. Wise

*Attorney, Agent, or Firm*—Robert J. Kraus

[57] ABSTRACT

A microwave component including an aerial comprised of at least a planar electrically conducting radiating element (3), arranged on a surface of a dielectric substrate (1). The surface is opposite a bearing surface which is at least partially covered with an electrically conducting layer serving as a ground plane (5). The microwave component further contains a microwave circuit used for processing and/or producing aerial signals. A dielectric film (2) is laid around the substrate (1). One side of this film (2) contains the radiating element (3), the ground plane (5) being arranged on the inside surface and the microwave circuit being arranged opposite the ground plane (5) on the outside surface. The aerial is further connected to the microwave circuit via a feeder line (4).

4 Claims, 1 Drawing Sheet

MICROWAVE COMPONENT

BACKGROUND OF THE INVENTION

The invention relates to a microwave component having an aerial comprised of a planar electrically conducting radiating element, arranged on a surface of a dielectric substrate, whose opposite bearing surface is at least partially covered with an electrically conducting layer, serving as a ground plane, and having a microwave circuit for processing and/or producing aerial signals.

Automatic transport or manufacturing systems utilize, for the identification of moving units (for example pallets, products), identification systems consisting of a microwave component, emitting an identification signal which is received by an evaluation unit. The received signals are evaluated in the evaluation unit and the moving unit is controlled in dependence on these signals. Such a microwave component comprises, as stated above, an aerial and a microwave circuit which reads the identification signals to be transferred from a memory and conveys them to the aerial. In some systems it is also customary to load the memory with always new identification signals, depending on the requirements. The new identification signals received by the aerial are further processed in the microwave circuit.

The aerial of such a microwave component has a substrate, which is connected to a metallized baseplate. The radiating element is situated on the surface opposite the baseplate. The thickness of the substrate depends on the desired intensity of the electromagnetic wave to be radiated and on the required frequency bandwidth. The microwave circuit of the microwave component is comprised of strip line elements and electronic components. In practice, the object is to obtain microwave circuits of the smallest possible dimensions. Therefore, strip lines of narrow widths are used, which are applied to a dielectric base material and whose thickness is much less than that of the substrate. In addition, the dispersion of the electromagnetic waves in the microwave circuit is thereby reduced. In the prior art components, the connection between the aerial and the microwave circuit is provided by contact pins, which lead through the aerial substrate and connect the radiating element to the microwave circuit. This requires several soldering operations.

SUMMARY OF THE INVENTION

It is an object of the invention to build in a simpler manner and realise in smaller dimensions a microwave component of the type mentioned in the preamble.

The object is achieved in that around the substrate a dielectric flexible film is applied on which the radiating element is deposited, on the inside surface of which the electrically conducting layer is deposited serving as a ground plane and on the outside surface of which the microwave circuit is arranged, located opposite the ground plane and connected to the aerial via a feeder line.

As the dielectric film is laid around the substrate, with the microwave component in accordance with the invention, the structure of the microwave component is very compact. The thickness of the flexible film is determined by the width of the strip line, whereas the thickness of the substrate is determined by the required frequency bandwidth and the radiation intensity of the electromagnetic waves. The ground plane is the reference potential for the aerial and the microwave circuit. The electrically conducting layers used here can be made of metal layers.

In order to avoid any additional losses of the electromagnetic waves emitted by the aerial, the radiating element and the feeder line are deposited on the outside surface of the film. In addition, the step of connecting the aerial to the microwave circuit by means of contact pins, customary so far, can be dispensed with as the connection is already established on the flexible film the moment the the metallised film is deposited.

A simple structure of the microwave component is realized when the ground plane fully covers the bearing surface of the substrate.

The microwave circuit, which can be comprised of a circuit in strip line technique and lumped components, is arranged on the outside surface of the dielectric film. Lumped components is understood to mean, for example, diodes, transistors, memories, resistors, capacitors etc. The strip line technique is used to realize the passive switching functions (for example couplings, phase shifts) and the connections.

The manufacture of a microwave component in accordance with the invention may include the following steps: first the required electrically conducting layers are applied to the dielectric film. This can, for example, be achieved by means of photolithography or by means of the thick-film-method.

The processed film is, for example, cemented to the dielectric substrate. Finally, the lumped components are placed on the microwave component.

BRIEF DESCRIPTION OF THE DRAWING

The invention will be described in greater detail with reference to the accompanying drawings, in which.

DESCRIPTION OF THE PREFERRED EMBODIMENT

Figure 1:
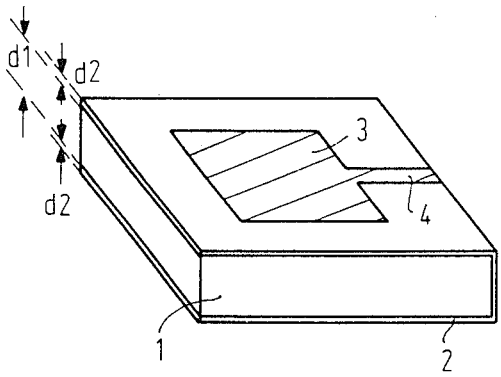
FIG. 1 is a perspective view of a microwave component in accordance with the invention and FIG. 2 is a perspective view of s substrate and of a metal-plated film during a stage of the manufacturing process of the microwave component in accordance with the invention.

FIG. 1 shows a schematic structure of an embodiment of the microwave component in accordance with the invention. The microwave component has a laminar dielectric substrate 1. A dielectric film 2 having an electrically conducting layer and a thickness d2 is laid around and rigidly connected to the substrate 1 and covers at least two opposite surfaces of the substrate. In practice, the substrate and the film are selected such that their dielectric constant is 2 to 5. The substrate can, for example, consist of an Epoxy resin, a polymer containing fluorine and the film can consist of a polyimide. The electrically conducting layer is usually a metal layer, for example, a copper layer. The distance between the two opposite surfaces of the substrate 1 is d1. The surfaces of the substrate 1 will hereinafter be denoted the aerial surface and bearing surface, respectively. The surface of the film which is rigidly attached to the substrate, will be denoted the inside surface and the opposite surface will be denoted the outside surface.

On the part of the outside surface of the film 2, lying opposite the inside surface of the film which is rigidly attached to the aerial surface of the substrate 1, a metal-layer planar aerial component 3 is deposited. On the inside surface of the film 2 rigidly attached to the bearing surface of the substrate 1, a metal layer is deposited which serves as the ground plane. On the outside surface of the film 2, lying opposite the ground plane, a microwave circuit is provided comprised of strip lines and lumped components. The strip lines provide the required passive switching functions and the connections between the lumped components. Lumped components can, for example, be semiconductors, memories and further components. The microwave circuit processes and produces, respectively, signals received and emitted, respectively, by the aerial composed of the radiating element 3, part of the film 2, substrate 1 and the ground plane.

The thickness d1 of the substrate 1 depends on the required radiation intensity of the electromagnetic waves. At, for example 2.45 GHz, this thickness can be 3 mm. The thickness d2 of the film 2 is determined by the requirements of the strip line. For the example described above a film having a thickness of 0.1 to 0.2 mm could be used with a proportionate width of the strip line. For the connection between the aerial component 3 and the microwave circuit, a feeder line 4 is used, deposited as a strip line on the outside surface of film 2. By using a flexible film a connection between the radiating element 3 and the microwave circuit is established in a simple manner.

Figure 2:
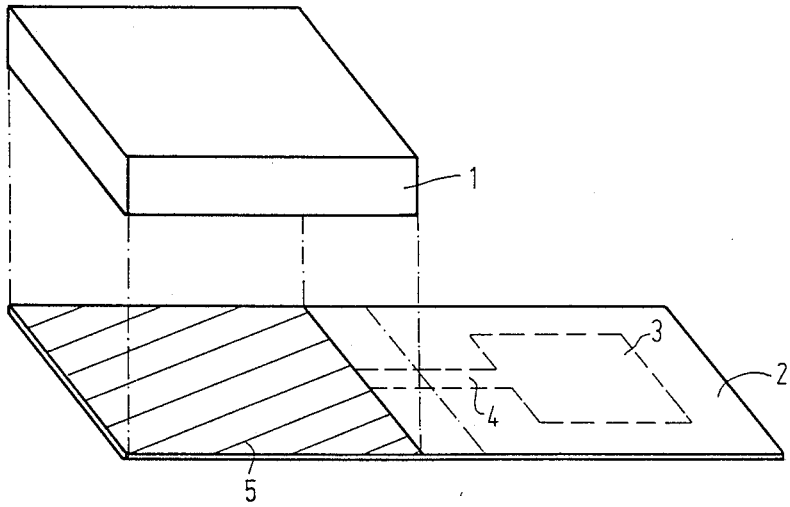

The process of fabricating a microwave component will hereinafter be described with reference to FIG. 2. In a first step the radiating element 3, the ground plane and the strip lines are formed by depositing metal layers on the flexible dielectric film. The pattern of the circuit comprising the ground plane, the radiating element and the strip line can, for example, be made with the aid of a photolithographic method or the thick-film technique. In the thick-film technique a metal powder paste is applied to the film and then heated. Circuit structures can then be realised by photo-etching or, when using the silk-screen printing technique, by printing them using masks and a conducting paste through a fine-mesh fabric. FIG. 2 shows the next step of the procedure. Here the substrate and the film are brought together and joined, for example, by means of cementing. The inside surface of this film with the ground plane 5 can be recognized on the flexible film 2, shown in FIG. 2. The strip line structures and the connection 4 between the microwave circuit and the radiating element 3 are shown on the outside. The broken line indicates the radiating element 3 deposited on the outside surface of the film 2, and the feeder line 4. After the film 2 is rigidly attached to the substrate 1, the lumped components are soldered to the outside surface. This can be realized with the aid of the SMD-technique (surface-mounted-devices), for example to save room.

It should further be noted, that a temperature compensation of the intermediate frequency of the aerial can be carried out, as also for other microwave aerials, provided that the substrate is composed of two layers having the same or different dielectric constants and temperature coefficients acting in opposite directions.

What is claimed is:

1. A microwave component for supporting and electrically connecting a planar, electrically-conductive aerial and a microwave circuit, said component comprising:

(a) a dielectric substrate having opposing first and second sides and a transverse side extending between the first and second sides;

(b) a flexible dielectric film wrapped around the dielectric substrate and covering at least part of each of the first side, the second side, and the transverse side; and (c) an electrically conductive layer serving as a ground plane disposed between the first side and the flexible dielectric film;

said flexible dielectric film having a continuous surface including a portion overlying the second side for supporting the aerial, a portion overlying the electrically-conductive layer for supporting the microwave circuit, and a portion overlying the transverse side for supporting a feeder line for electrically connecting the aerial to the microwave circuit.

2. A microwave component as in claim 1 where said continuous surface of the flexible dielectric film is on an outer side thereof remote from the dielectric substrate.

3. A microwave component as in claim 1 or 2 where the electrically-conductive layer is disposed on the first side of the dielectric layer.

4. A microwave component as in claim 3 where the electrically-conductive layer covers substantially the entire first side of the dielectric substrate.

* * * * *